US005992387A

United States Patent [19]

Holtman et al.

[11] Patent Number: 5,992,387

[45] Date of Patent: Nov. 30, 1999

[54] FUEL SYSTEM HAVING PRIMING ACTUATING FLUID RESERVOIR

[75] Inventors: Richard H. Holtman, Dunlap, Ill.; James K. Vallance, Northville; David M. Foulkes, West Bloomfield, both of Mich.

[73] Assignees: Caterpillar, Inc., Peoria, Ill.; Ford Motor Company, Dearborn, Mich.

[21] Appl. No.: 08/627,577

[22] Filed: Apr. 4, 1996

[51] Int. Cl.[6] ..... F02M 37/04

[52] U.S. Cl. ..... 123/447; 123/456

[58] Field of Search ..... 123/447, 446, 123/456, 467

[56] References Cited

U.S. PATENT DOCUMENTS

| | | | |
|---|---|---|---|
| 4,485,789 | 12/1984 | Walter et al. | 123/467 |
| 5,168,855 | 12/1992 | Stone | 123/446 |
| 5,176,115 | 1/1993 | Campion | 123/179.17 |
| 5,181,494 | 1/1993 | Ausman et al. | 123/446 |
| 5,191,867 | 3/1993 | Glassey | 123/446 |
| 5,213,083 | 5/1993 | Glassey | 123/447 |
| 5,245,970 | 9/1993 | Iwaszkiewicz et al. | 123/447 |
| 5,297,523 | 3/1994 | Hafner et al. | 123/456 |

*Primary Examiner*—Carl S. Miller

*Attorney, Agent, or Firm*—Marshall, O'Toole, Gerstein, Murray & Borun

[57] ABSTRACT

A fuel system of a fuel injected engine includes a separate priming actuating fluid reservoir connected to an actuating fluid manifold and a high pressure pump for maintaining the volume of oil at the manifold and pump during periods when the engine is not in operation.

15 Claims, 1 Drawing Sheet

FUEL SYSTEM HAVING PRIMING ACTUATING FLUID RESERVOIR

TECHNICAL FIELD

The present invention relates to a fuel system of a fuel injected engine and more particularly to a priming actuating fluid reservoir connected to a high pressure actuating fluid pump and a high pressure actuating fluid manifold.

BACKGROUND ART

In the construction of diesel engines, particularly diesel engines of earthworking machines, space is severely limited for locating and positioning various components of the engine and components associated with the engine. It has also been a problem to maintain actuating fluid lines which power the fuel injectors filled to capacity during periods when the engine is shut down for an extended period and/or during cold weather conditions. During such times, actuating fluid occasionally drains out of the system and/or the volume of actuating fluid decreases in response to cooling thereof. This reduction in the volume of actuating fluid can result in the introduction of air into the system, leading to an undesirable increase in cranking times during cold-weather starts. In order to overcome this problem, actuating fluid must be supplied to the system so that sufficient pressure can be developed to inject fuel into the combustion chambers and start the engine.

Glassey, U.S. Pat. No. 5,213,083, assigned to the assignee of the instant application, discloses a hydraulically actuated fuel injection system including a high pressure actuating fluid pump for developing high pressure actuating fluid for fuel injectors and a priming reservoir arranged in fluid communication between a sump and an inlet of the pump. The priming reservoir primes and thereby facilitates rapid pressurization of the high pressure pump during engine start-up so that long cranking times are avoided. In addition, means are provided for automatically making up or replenishing voids in manifolds downstream of the pump due to cooling and contraction of actuating fluid and/or precipitation of entrained air from the actuating fluid. Such means comprises an actuating fluid siphon passage having a check valve therein which bypasses the inlet of the high pressure pump and is connected directly between the priming reservoir and the manifolds.

While the fuel injection system disclosed in the above-identified Glassey '083 patent is effective to limit cranking times, it is necessary that the lowest level of the actuating fluid in the reservoir be higher than the pump inlet. In installations where sufficient space above the pump mounting location is not available or in a situation where the pump mounting location is at a low elevation compared to the engine head and injectors, the system disclosed in Glassey '083 patent may not be suitable.

The present invention is directed to overcoming one or more of the problems as set forth above.

DISCLOSURE OF THE INVENTION

In accordance with one aspect of the present invention, a fuel system for an engine having a fuel injector which is actuable by an actuating fluid includes a pump for pressurizing actuating fluid, a manifold coupled between the pump and the fuel injector and transmitting pressurized actuating fluid from the pump to the fuel injector and a housing separate from the engine and positioned about the manifold. A priming actuating fluid reservoir is disposed within the housing at an elevation higher than the manifold and is coupled to the manifold for supplying actuating fluid thereto.

Preferably, a check valve is coupled between the manifold and the reservoir and is oriented to prevent fluid flow from the manifold to the reservoir. Also preferably, the reservoir is connected to an inlet of the pump and is further disposed at an elevation higher than the pump.

Further in accordance with the preferred embodiment, means are provided for bleeding air from the reservoir and means may also be provided for adding actuating fluid to the reservoir. Still further, the actuating fluid preferably comprises engine oil.

In accordance with a further aspect of the present invention, a fuel system for a fuel injected engine having a fuel injector which is actuable by an actuating fluid when the engine is running includes a pump operable when the engine is running for pressurizing actuating fluid and a manifold coupled between the pump and the fuel injector and transmitting pressurized actuating fluid from the pump to the fuel injector. A housing separate from the engine is positioned about the manifold and a priming actuating fluid reservoir is disposed within the housing at an elevation higher than at least one of the pump and the manifold and is coupled to the pump and manifold for supplying actuating fluid thereto when the engine is not running.

In accordance with a still further aspect of the present invention, a hydraulically actuated fuel system for a diesel engine having a plurality of fuel injectors each of which is actuable by high pressure engine oil when the engine is running includes a high pressure pump operable when the engine is running for pressurizing engine oil, a rail pressure control valve coupled between the pump and a high pressure oil rail and a housing carried by the engine. A manifold is disposed in the housing and is coupled between the oil rail and the fuel injectors and transmits high pressure engine oil from the pump to the fuel injectors. A reservoir is disposed at an elevation higher than the manifold and the pump and is coupled to the manifold and the pump for supplying engine oil thereto when the engine is not running. A check valve is coupled between the manifold and the reservoir and prevents flow of engine oil from the manifold to the reservoir.

The present invention reduces cranking times by providing actuating fluid as required to an actuating fluid manifold and is suitable for installation in locations where sufficient space above the pump mounting location is unavailable or where the pump mounting location is physically low compared to the engine head and the fuel injectors. Further, as compared to systems where the reservoir is integral with the high pressure pump, the complexity of the oil pump is advantageously reduced.

BRIEF DESCRIPTION OF THE DRAWING

The sole FIGURE is a diagrammatic view of the fuel system of the present invention.

BEST MODE FOR CARRYING OUT THE INVENTION

Figure 1:
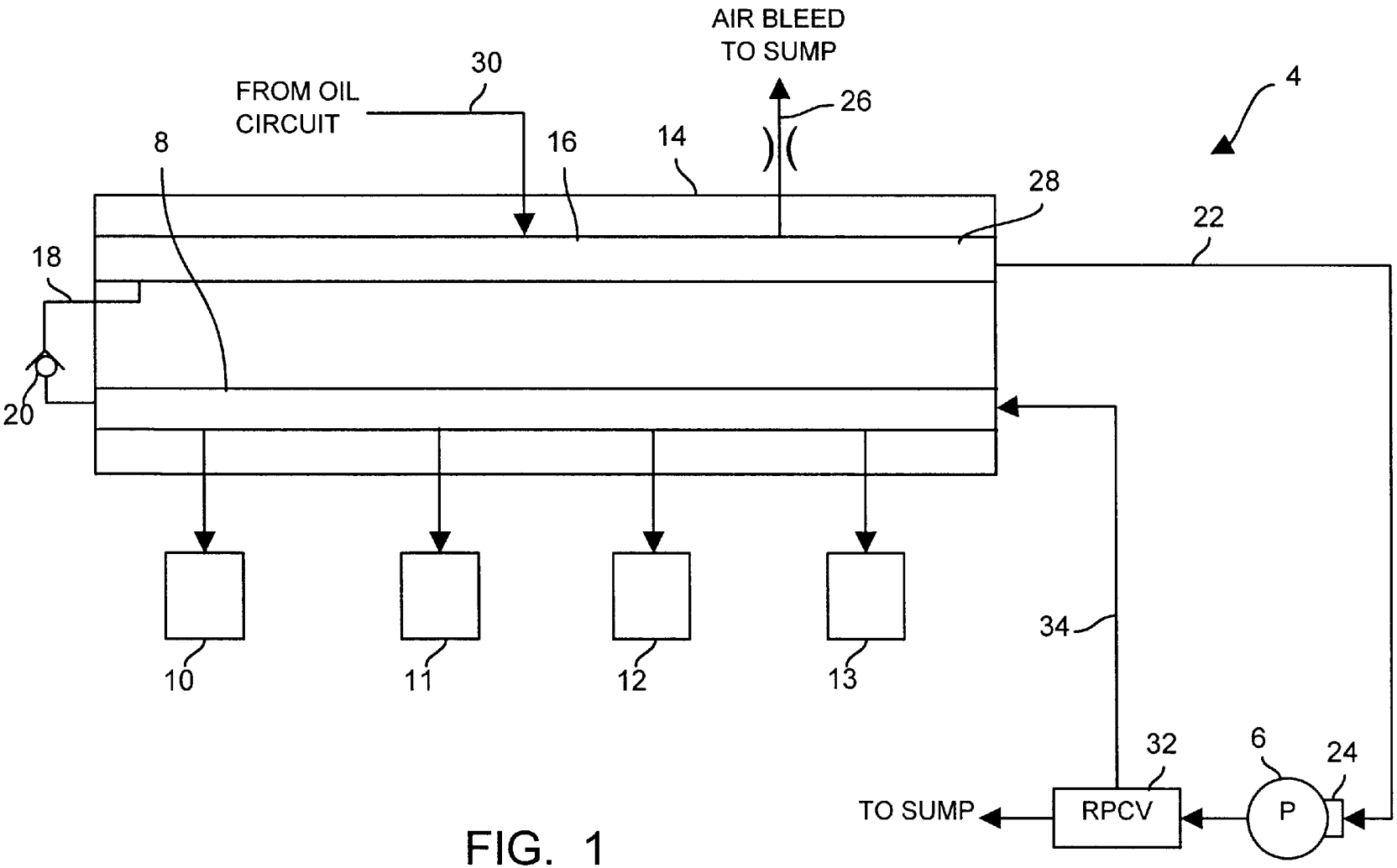

Referring to the drawing, a fuel injected engine, preferably a diesel engine, includes a fuel system 4 having a high pressure actuating fluid pump 6 connected to and in fluid communication with a high pressure actuating fluid manifold 8. As is further known in the art, the manifold 8 is connected to a plurality of fuel injectors 10–13 for controllably supplying fuel to a like number of combustion chambers (not shown) of the engine. While four fuel injectors 10–13 for supplying fuel to four associated combustion chambers are shown in the drawing, the engine may include a different number of fuel injectors and associated combustion chambers. Further, one or more additional manifolds may be provided wherein each manifold supplies fuel to a portion of the total number of fuel injectors of the engine, if desired.

A housing 14 is positioned about the high pressure actuating fluid manifold 8. A priming actuating fluid reservoir 16 separate from the manifold 8 is positioned within the housing 14 at a elevation higher than at least one of the actuating fluid manifold 8 and the high pressure actuating fluid pump 6. Preferably, the priming actuating fluid reservoir 16 is positioned at a higher elevation than both the manifold 8 and the pump 6.

A first conduit 18 is connected at one end to the priming actuating pump reservoir 16 and at another end to the high pressure actuating fluid manifold 8, thereby placing the reservoir 16 in fluid communication with the manifold 8. A check valve 20 is positioned in the first conduit 18 and is oriented in a manner to prevent actuating fluid flow from the high pressure actuating fluid manifold 8 into the priming actuating fluid reservoir 16.

A second conduit 22 is connected at one end to the priming actuating fluid reservoir 16 and at another end to an intake 24 of the high pressure actuating fluid pump 6.

A third conduit 26 is connected to and in fluid communication with an upper portion 28 of the priming actuating fluid reservoir 16 and is adapted to bleed air from the priming actuating fluid reservoir 16 when filling. A fourth conduit 30 is connected to and in fluid communication with the priming actuating fluid reservoir 16. Preferably, the actuating fluid comprises engine oil and the fourth conduit is coupled to an actuating fluid supply circuit including a transfer pump (not shown) for transferring engine oil to the reservoir 16.

A rail pressure control valve 32 is disposed in fluid communication between the pump 6 and a high pressure conduit 34 coupled to the manifold 8 and controls the fluid pressure of the actuating fluid supplied thereto.

In the event that the engine includes multiple manifolds each supplying actuating fluid to a portion of the total number of fuel injectors of the engine, each manifold is preferably disposed in a housing together with a reservoir as seen in the drawing. Further, all of the manifolds are preferably coupled to the rail pressure control valve 32 and receive actuating fluid via the conduit 30. Also preferably, only one of the reservoirs is coupled to the inlet of the pump 6, although the pump 6 could alternatively receive actuating fluid from multiple reservoirs.

INDUSTRIAL APPLICABILITY

After engine shut-down, cooling and contraction of actuating fluid and/or precipitation of entrained air from the actuating fluid can create voids in the manifold 8. This lost volume of actuating fluid in the manifold 8 typically results in a delay in engine start-up during cranking until the pump 6 is able to refill the lost volume in the manifold 8. In order to reduce or eliminate this problem, the manifold 8 is kept in a filled condition through makeup of actuating fluid from the priming actuating fluid reservoir 16 through the first conduit 18 and the check valve 20. In addition, sufficient actuating fluid is available to the pump 6 from the reservoir 16 so that the rail pressure control valve 32 can provide actuating fluid under pressure to the manifold 8.

After actuating fluid is transferred from the reservoir 16 to the manifold 8 and the engine is again started, the reservoir 16 is refilled with actuating fluid via the conduit 30. Air displaced by the actuating fluid is vented through the conduit 26.

The present invention is effective to provide quick cold start-ups of the engine and is suitable for installation in locations where only limited space above the pump mounting location is available or where the pump is mounted at a location below the engine head and the injectors. Specifically, incorporation of the reservoir in a housing above the manifold permits the manifold to be continuously charged with actuating fluid even while the engine is not running. Further, because the pump 6 is preferably also located at an elevation below the reservoir 16, the pump is also supplied with sufficient actuating fluid while the engine is not running to permit quick start-ups.

The present invention also advantageously results in reduced complexity of the oil pump as compared to other systems where the reservoir is incorporated in a housing with the pump and may result in lower overall costs.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A fuel system for a fuel injected engine having a fuel injector which is actuable by an actuating fluid when the engine is running, comprising:

a pump operable when the engine is running for pressurizing actuating fluid;

a manifold coupled between the pump and the fuel injector and transmitting pressurized actuating fluid from the pump to the fuel injector;

a housing separate from the engine and positioned about the manifold; and a priming actuating fluid reservoir disposed within the housing at an elevation higher than at least one of the pump and the manifold and coupled to the pump by a conduit and further coupled to the manifold by an additional conduit for directly supplying actuating fluid from the reservoir to the manifold when the engine is not running.

2. The fuel system of claim 1, further including a check valve coupled between the manifold and the reservoir and oriented to prevent fluid flow from the manifold to the reservoir.

3. The fuel system of claim 1, wherein the reservoir is disposed at an elevation higher than the pump and the manifold.

4. The fuel system of claim 1, further including means for bleeding air from the reservoir.

5. The fuel system of claim 1, further including means for adding actuating fluid to the reservoir.

6. The fuel system of claim 1, wherein the actuating fluid comprises engine oil.

7. A hydraulically-actuated fuel system for a diesel engine having a plurality of fuel injectors each of which is actuable by high pressure engine oil when the engine is running, comprising:

a high pressure pump operable when the engine is running for pressurizing engine oil;

a rail pressure control valve coupled between the pump and a high pressure conduit;

a housing carried by the engine and separate therefrom;

a manifold disposed in the housing and coupled between the high pressure conduit and the fuel injectors and transmitting high pressure engine oil from the pump to the fuel injectors;

a reservoir in the housing and disposed in the housing at an elevation higher than the manifold and the pump and coupled to the manifold and the pump for supplying engine oil thereto when the engine is not running; and a check valve directly coupled between the manifold and the reservoir for preventing flow of engine oil from the manifold to the reservoir.

8. The fuel system of claim 7, further including means for bleeding air from the reservoir.

9. The fuel system of claim 8, further including means for adding actuating fluid to the reservoir.

10. A fuel system for a fuel injected engine having a fuel injector which is actuable by an actuating fluid, comprising:

a pump for pressurizing actuating fluid;

a manifold coupled between the pump and the fuel injector and transmitting pressurized actuating fluid from the pump to the fuel injector;

a housing separate from the engine and positioned about the manifold; and a priming actuating fluid reservoir disposed within the housing at an elevation higher than the manifold and coupled to the manifold for priming the manifold by supplying actuating fluid thereto.

11. The fuel system of claim 10, further including a check valve coupled between the manifold and the reservoir and oriented to prevent fluid flow from the manifold to the reservoir.

12. The fuel system of claim 10, wherein the reservoir is connected to an inlet of the pump and is further disposed at an elevation higher than the pump.

13. The fuel system of claim 10, further including means for bleeding air from the reservoir.

14. The fuel system of claim 10, further including means for adding actuating fluid to the reservoir.

15. The fuel system of claim 10, wherein the actuating fluid comprises engine oil.

* * * * *